US007219609B1

(12) United States Patent
Utz et al.

(10) Patent No.: US 7,219,609 B1
(45) Date of Patent: May 22, 2007

(54) APPARATUS FOR SHIPPING AND INSTALLATION OF ATM

(75) Inventors: Zachary Utz, North Canton, OH (US); Douglas A. Kovacs, Canton, OH (US)

(73) Assignee: DieBold Self-Service Systems division of DieBold, Incorporated, North Canton, OH (US)

( * ) Notice: Subject to any disclaimer, the term of this patent is extended or adjusted under 35 U.S.C. 154(b) by 215 days.

(21) Appl. No.: 11/029,037

(22) Filed: Jan. 4, 2005

Related U.S. Application Data

(60) Provisional application No. 60/534,529, filed on Jan. 5, 2004.

(51) Int. Cl.
*B65D 19/44* (2006.01)
*E05G 1/04* (2006.01)

(52) U.S. Cl. ..... 108/57.21; 108/55.3; 109/52

(58) Field of Classification Search ..... 108/54.1, 108/55.1, 55, 56.1, 50.01, 57.12, 57.16, 57.17, 108/57.21, 57.26; 109/52 R, 52; 235/379–381; 248/346.01; 410/67, 96
See application file for complete search history.

(56) References Cited

U.S. PATENT DOCUMENTS 1,129,775 A * 2/1915 Anthony ..... 108/54.1
5,449,266 A * 9/1995 Evans ..... 414/458
5,676,063 A * 10/1997 Wallace ..... 108/57.17
5,787,817 A * 8/1998 Heil ..... 108/57.21
5,970,885 A * 10/1999 Polando ..... 108/55.3
5,970,890 A * 10/1999 Harry et al. ..... 109/59 R
6,006,675 A * 12/1999 Heil ..... 108/55.3
6,089,168 A * 7/2000 Dunlap et al. ..... 109/59 R
6,112,672 A * 9/2000 Heil ..... 108/55.3
6,126,131 A * 10/2000 Tietz ..... 248/346.01
6,263,806 B1 * 7/2001 Heil ..... 108/55.3
6,308,396 B1 * 10/2001 Lewis et al. ..... 29/467
6,524,040 B1 * 2/2003 Heil ..... 410/67
6,871,602 B2 * 3/2005 McCracken et al. ..... 109/59 R
6,896,181 B2 * 5/2005 Utz ..... 235/379

* cited by examiner

*Primary Examiner*—Bryon P. Gehman
(74) *Attorney, Agent, or Firm*—Daniel D. Wasil; Ralph E. Jocke; Walker & Jocke

(57) ABSTRACT

An apparatus and method for the shipping and installation of an ATM. The ATM comprises leveling legs. A pallet includes a plurality of readily separable components and a plurality of component fasteners. The pallet further comprises bracket openings which align with the leveling legs allowing vertical movement of the leveling legs therethrough. The leveling legs are extendable in the openings to lift and support the ATM from an underlying floor surface, allowing the underlying pallet to be disassembled. The ATM can be leveled using the leveling legs.

20 Claims, 6 Drawing Sheets

APPARATUS FOR SHIPPING AND INSTALLATION OF ATM

CROSS REFERENCE TO RELATED APPLICATION

This application claims benefit pursuant to 35 U.S.C. § 119(e) of U.S. Provisional Application Ser. No. 60/534,529 filed Jan. 5, 2004.

TECHNICAL FIELD

This invention relates to the shipping and installation of an automated teller machine (ATM). Specifically this invention relates to apparatus and methods which provide for the reliable transport and more rapid installation of ATMs.

BACKGROUND ART

When shipping an ATM, the ATM is frequently secured to a shipping pallet to provide protection, stability, and ease of handling. During shipping, machines occasionally incur damage due to the combination of external impact loads and the relative rigidity of most shipping pallets. Furthermore, when an ATM arrives at its final destination and requires installation, the machine must be lifted off the pallet for installation. This lifting often requires expensive equipment, manpower and time, and may pose a risk of damage to the machine or personnel involved. For purposes of this disclosure, an ATM includes all types of financial transaction machines. The term pallet includes any type of dunnage used for shipping purposes.

DISCLOSURE OF INVENTION

It is an object of an exemplary form of the present invention to provide a shipping and installation apparatus and method which provides improved protection of ATMs during shipment, and also provides for more rapid, inexpensive, and safe installation of ATMs.

It is a further object of an exemplary form of the present invention to provide a shipping and installation apparatus and method which is compatible with standard lifting devices.

Further objects of exemplary forms of the present invention will be made apparent in the following Best Modes for Carrying Out Invention and the appended claims.

The foregoing objects may be accomplished in an exemplary embodiment by a shipping and installation apparatus, which includes a cash dispensing ATM comprising a plurality of vertical adjustment and support devices, and a pallet comprising a plurality of readily separable pallet components held in an assembled condition with a plurality of component fasteners. The plurality of exemplary pallet components may further include pallet components of a cushioning material such as polyethylene foam to provide shock absorbing characteristics during the shipping and installation process. Other embodiments may include shipping materials other than that of the pallet, as well as other types of vertically movable supports.

In operation, the plurality of pallet components of an exemplary embodiment are held in an assembled condition with a plurality of component fasteners. The ATM is secured to the pallet, aligning the plurality of vertical adjustment and support devices with predetermined pallet openings to enable vertical movement of the devices in the openings. In an exemplary embodiment the vertical adjustment and support devices may be moved to firmly engage bracket portions of the pallet to help secure the ATM and pallet in engagement.

The ATM and pallet are then transported to a remote facility which will be the installation location of the ATM. Once in position, the ATM is unsecured relative to the pallet. This can include moving the adjustment and support devices from firm engagement with the bracket portions. The ATM is then lifted by extending downward the plurality of vertical adjustment and support devices, so that the ATM is supported by a floor surface beneath the pallet, and the pallet is no longer supporting the ATM. The pallet is then disassembled, by removing a plurality of component fasteners and separating the plurality of pallet components. The pallet components are then moved so as to no longer be positioned beneath the ATM. The ATM may then be lowered through operation of the plurality of vertical adjustment and support devices. In some embodiments, the ATM may be moved into engagement with the supports of a lift truck, hand truck or other movable lifting device, for movement to a final location in the facility. The ATM, once in final position, is leveled relative to the supporting surface using the plurality of vertical adjustment and support devices.

In this exemplary manner, the time, material and equipment needed to install an ATM shipped on a pallet is substantially reduced. While the installation of an ATM using traditional methods often involves hours of labor, risk of damage, and expensive lifting equipment, the use of this exemplary apparatus and method may allow one worker to remove the pallet material and move the ATM to its final operating position in approximately ten minutes using only hand tools.

BEST MODES FOR CARRYING OUT INVENTION

Figure 1:
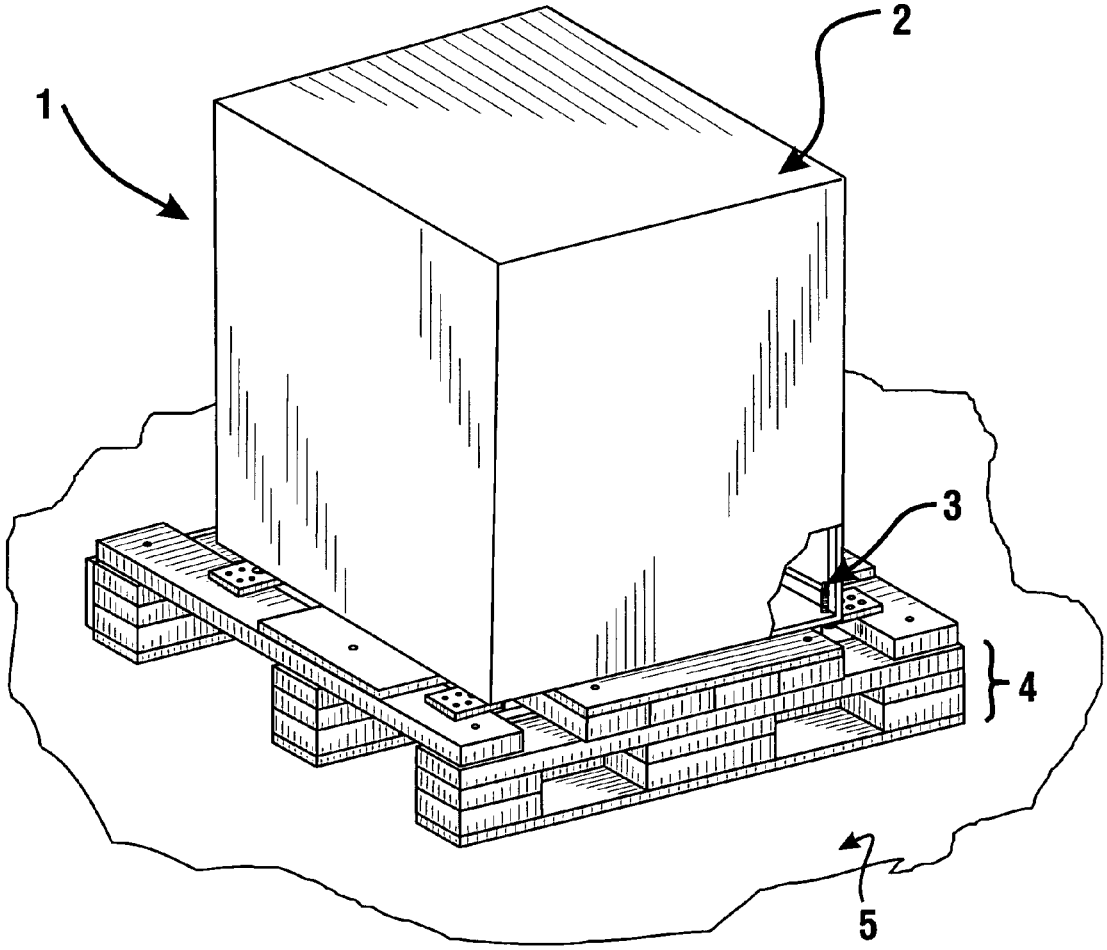
FIG. 1 is a perspective view representative of an exemplary embodiment of the shipping pallet apparatus and ATM.

Referring now to the drawings and particularly to FIG. 1, there is shown therein a perspective view of an exemplary ATM shipping and installation apparatus 1. The ATM shipping and installation apparatus may include a cash dispensing ATM 2. The ATM has a plurality of vertically movable support legs which serve as an exemplary form of vertical adjustment and support devices 3. As shown, a pallet 4 supports the ATM. The pallet is supported on a floor surface 5. The ATM further comprises a base portion 29 discussed later in connection with FIG. 6. The ATM may be one of the types shown in U.S. Pat. No. 6,010,065, the disclosure of which is incorporated herein by reference. In alternative embodiments the ATM could be of another type and may be supported by a differently configured pallet or shipping dunnage mechanism. Similarly, the pallet 4 is exemplary, and a number of other shipping dunnage mechanisms may be used in other embodiments.

Figure 2:
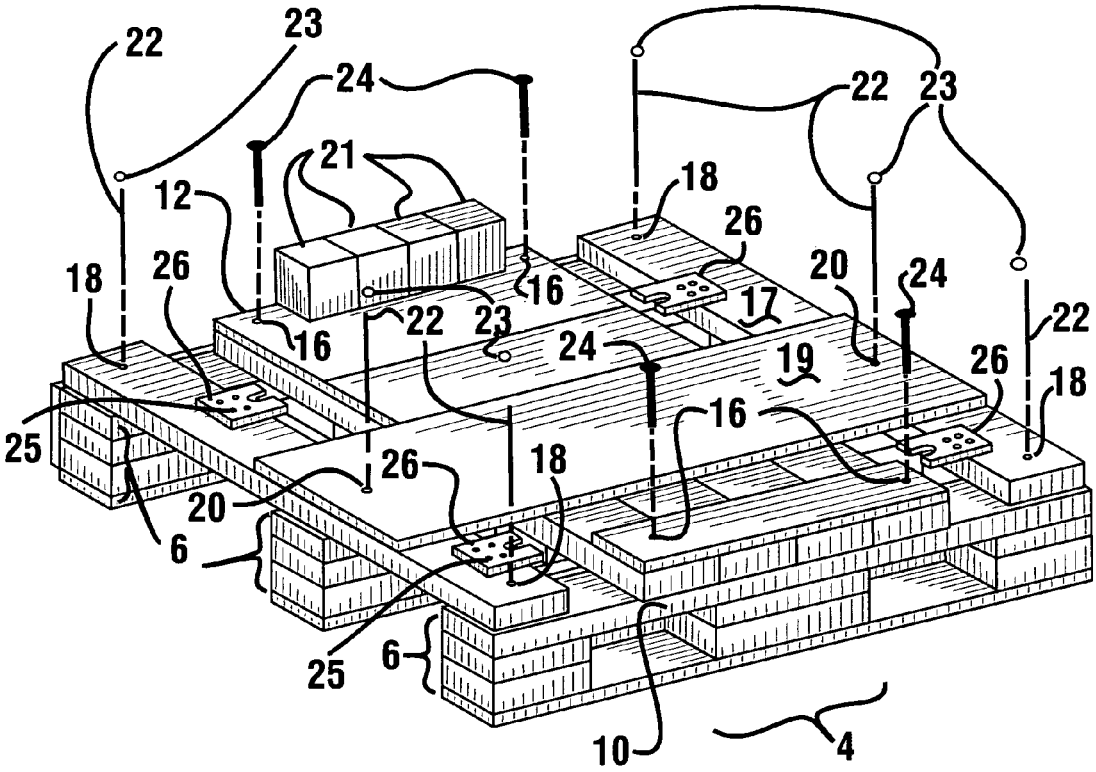
FIG. 2 is a perspective view of the assembled pallet.
Figure 3:
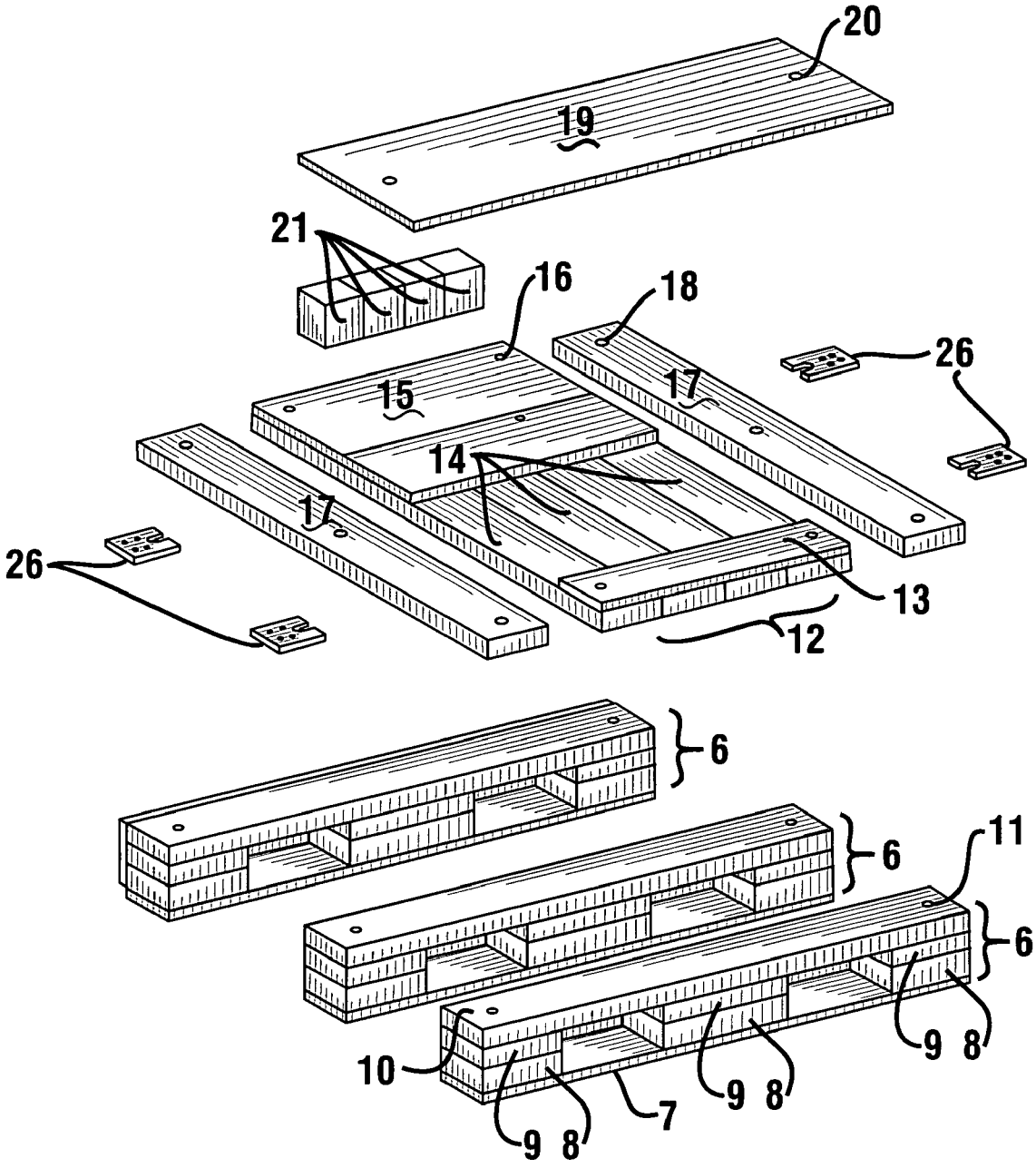
FIG. 3 is an exploded view of the pallet components of the pallet.

The exemplary pallet 4 is comprised of a plurality of readily separable pallet components. In an assembled condition, the components are maintained connected using a plurality of component fasteners. Referring to FIG. 2, there is shown a perspective view of the assembled pallet 4. This assembled pallet will be later discussed in detail. Referring to FIG. 3, there is shown an exploded view of the plurality of pallet components and plurality of component fasteners of the exemplary embodiment of pallet 4. The exemplary pallet components include a plurality of base support assemblies 6, a mid support assembly 12, a plurality of side supports 17, an upper plate 19, a plurality of installation blocks 21 and a plurality of cantilever shipping brackets 26. The plurality of exemplary component fasteners include a plurality of bolts 22, a plurality of tee nuts 23, a plurality of lag screws 24 and a plurality of screws 25. Of course, in other embodiments other fastener types may be used.

The exemplary base support assembly 6 includes a bottom plate 7, a plurality of lower supports 8, a plurality of upper supports 9, and a top plate 10. The bottom plate 7, lower supports 8, upper supports 9 and top plate 10 of the exemplary embodiment are attached in a collinear fashion on parallel planes by fasteners, adhesive, or any other fastening devices. A vertical base support hole 11 is provided at each end of the base support assembly 6 for the receipt of the bolts 22. The bottom plate 7, lower supports 8, upper supports 9 and top plate 10 of the exemplary embodiment are constructed of wood, although in other embodiments other suitable structural materials may be used. As a specific alternate embodiment, the upper supports 9 may be comprised of polyethylene foam, although other durable cushion materials may be used. This use of the polyethylene foam or other cushion material provides resiliency in the pallet and provides for additional protection of the ATM during shipment and installation from shock and vibration.

The mid support assembly 12 comprises a front plate 13, a plurality of longitudinal plates 14, and a back plate 15. The front plate 13 and the back plate 15 are attached to the upper surface immediately adjacent longitudinal plates 14 by fasteners, adhesives, or other suitable means. A vertical mid support hole 16 is provided at each corner of the mid support assembly 12 for the receipt of lag screws 24. The front plate 13, rear plate 15, and plurality of longitudinal plates 14 of the exemplary embodiment are made from wood, although in other embodiments other suitable structural materials may be used.

The side supports 17 are provided with a plurality of vertical side support holes 18 at the center and end sections of the side supports 17 to receive bolts 22. The upper plate 19 has a vertical upper plate hole 20 provided in the central section at each end of the upper plate 19 for the receipt of the bolts 22. The side supports 17 and upper plate 19 are comprised of wood in the exemplary embodiment. However, in other embodiments other suitable structural materials may be used.

Figure 4:
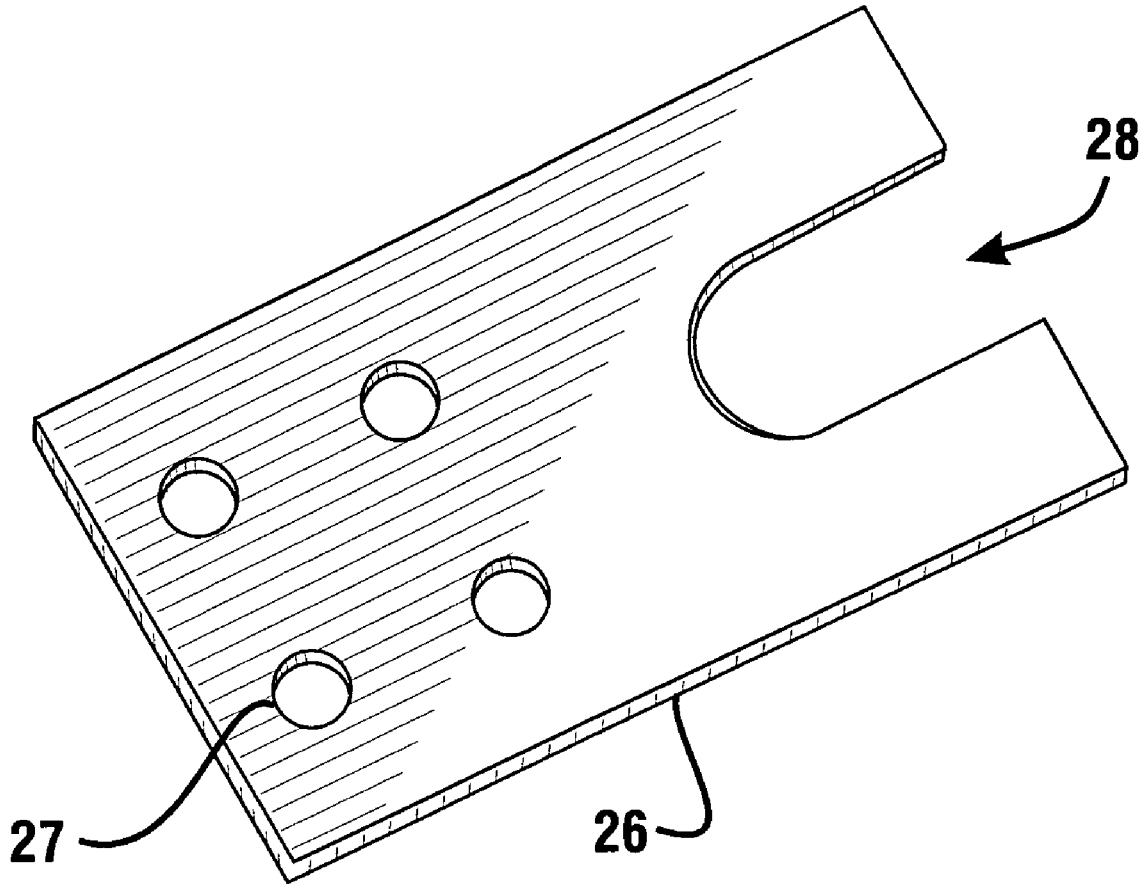
FIG. 4 is a view of the cantilever shipping bracket.

The exemplary cantilever shipping bracket 26 is illustrated in detail in FIG. 4. The cantilever shipping bracket 26 has a plurality of vertical shipping bracket holes 27 provided for the receipt of lag screws 24 which engage and attach the shipping bracket to the pallet. The cantilever shipping bracket 26 has an open end shipping bracket slot 28 through which the vertical adjustment and support device vertically extends. Their size and configuration of this open end shipping bracket slot 28 may vary based upon the type and size of vertical adjustment and support devices utilized. In the exemplary embodiment, the cantilever shipping bracket is comprised of steel, although in other embodiments other suitable structural materials may be used.

Figure 5:
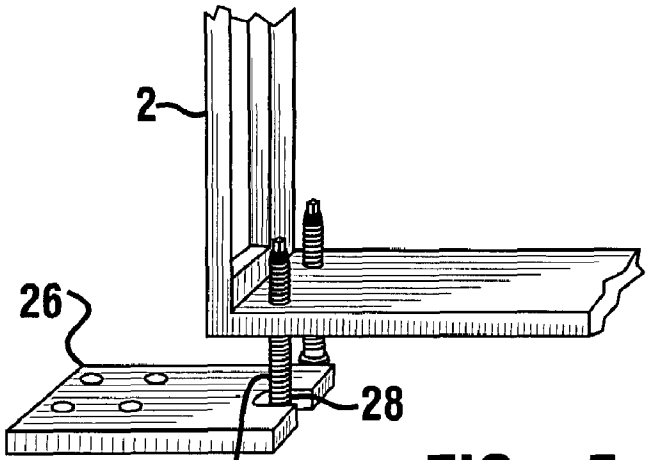
FIG. 5 is a perspective view of the exemplary embodiment of the vertical adjustment and support device in an ATM.

FIG. 5 illustrates the exemplary embodiment of the plurality of vertical adjustment and support devices used on the ATM. In this case, the plurality of vertical adjustment and support devices used include a plurality of leveling legs. The leveling legs are operative to support the ATM on a floor surface after removal from the pallet. Such legs may also be adjustable in height to account for surfaces which are not level or uneven. In addition, the height which the exemplary legs extend beneath the ATM can be adjusted from within the interior of a chest portion of the ATM. The chest portion may include a suitable chest door for controlling access thereto as shown in U.S. Pat. No. 6,010,065, the disclosure of which is incorporated herein by reference. The chest portion may also house currency supplies, a currency dispenser mechanism, and other components of the ATM.

Figure 6:
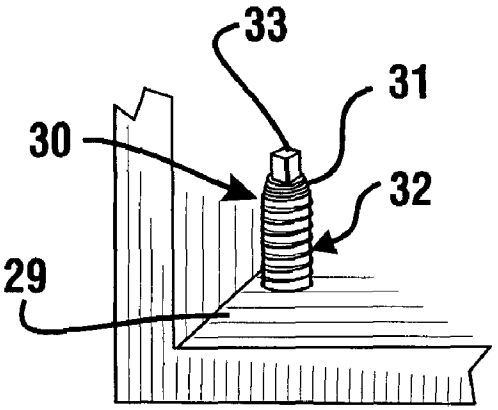
FIG. 6 is a detailed drawing of a leveling leg within the base of the ATM.
Figure 7:
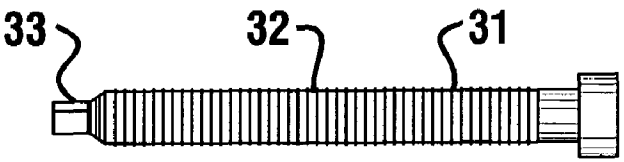
FIG. 7 is a detailed drawing of a leveling leg.

FIG. 5 shows an exemplary embodiment of a leveling leg 31 in operative connection with the ATM 2. As shown in FIGS. 6 and 7 the leveling leg may include a threaded shaft 32 that is in threaded connection with the ATM. Each leg is enabled to be moved up or down within a threaded hole 30 through the base portion 29 which bounds the bottom of the chest of the ATM. The leg may include a tool engaging head 33 which has a size and configuration that is adapted to be turned by a wrench or other device within the chest to move the leg up and down with respect to the bottom of the ATM.

To install the exemplary ATM, one or more of the leveling legs may be rotated to increase or decrease the length of the leveling legs that extended below the bottom of the ATM chest portion. In the exemplary embodiment, the leveling process may include opening a door of the chest portion of the ATM and turning one or more of the tool receiving ends of the leveling legs with a wrench or other device. In this manner, the ATM may be lowered or raised through use of a wrench, socket, or other device. In the exemplary embodiment, the ATM comprises four leveling legs, although other embodiments may include other numbers of leveling legs, or a combination of leveling legs and stationary support points or other supports in operative supporting connection with the ATM. The plurality of vertical adjustment and support devices are therefore operably connected to the base of the ATM with each respective vertical adjustment and support device allowing both vertical adjustment and support to the ATM. Of course, in other embodiments other types of vertically movable supports may be used, such as for example devices which incorporate jacks, cylinders, worm drives, gear racks, or other devices that can be operatively connected to the ATM to move it up and/or down.

FIG. 5 also shows the engagement of the exemplary cantilever shipping bracket 26 with the leveling leg 31. The cantilever shipping bracket open end slot 28 is engaged with the leveling leg 31 such that when the leveling leg 31 is retracted fully upward, it holds the ATM 2 and the cantilever shipping bracket 26 in firm engagement. When the cantilever shipping bracket 26 is secured to the pallet side support 17 through use of lag screws 24, the ATM is effectively secured to the pallet 4. The cantilever shipping bracket 26 is in aligned position with a vertically extending opening in the pallet and is aligned with the leveling leg 31 to enable vertical movement of the leveling leg 31 in the opening thorough the pallet 4 and in the slot of the shipping bracket.

Referring now to FIG. 2 which illustrates the assembled pallet 4, the exemplary pallet 4 is assembled as follows:

The base support assemblies 6 are operatively attached to the side supports 17 utilizing bolts 22 through base support holes 11 and the side support holes 18 on the end of the side supports 17, securing the components by engaging the bolts 22 with the tee-nuts 23.

The mid support assembly 12 is operatively attached to the top surface of base support assemblies 6 utilizing lag screws 24 through mid support holes 16, engaging the threads of the lag screws 24 into the top plate 10 of the base support assemblies 6.

The upper plate 19 is operatively secured to the pallet utilizing bolts 22 through the upper plate holes 20, through the center side plate holes 18, and through the base support holes 11, securing the components by engaging the bolts 22 with the tee-nuts 23.

The installation blocks 21 are releasibly attached to the back plate 15 of the pallet utilizing screws 25.

The assembled pallet 4 in the exemplary embodiment is approximately 43" wide, 47" deep and 6" high, although various sizes could be used depending on the type and configuration of ATM being shipped and installed.

The ATM 2 is then placed in supporting connection above the pallet. The cantilever shipping brackets 26 are attached to the side plates 17 utilizing lag screws 24 through holes 27. The ATM is positioned in such a manner relative to the exemplary pallet that the open end shipping bracket slots 28 can be moved horizontally so that each of the leveling legs 31 extends in a slot and is vertically movable therein. As previously indicated, the openings in the pallet are adapted to respectively align with the leveling legs to enable vertical movement therein.

In the exemplary method, each of the leveling legs 31 are then retracted upward until tightened against a corresponding cantilever shipping bracket, and all pallet component fasteners are then tightened to provide a secure shipping condition, thereby operably connecting the ATM and the plurality of pallet components for shipping. Additional or alternative methods of securing the ATM may also be employed. In this manner, the pallet supports the ATM and allows vertical movement of the vertical adjustment and support devices from the bottom of the ATM.

Although in the exemplary embodiment the ATM is placed in supporting connection with the pallet after the ATM is in an assembled condition, in alternative embodiments the ATM may be assembled in whole or in part in supporting connection with the pallet.

Once the ATM is in supporting connection and in secured engagement with the pallet, the ATM and pallet are shipped to the installation site and placed upon a floor surface of the installation site. The installation site may be the exact physical location where the ATM will be installed for operation or may be a convenient location within proximity to where the ATM will be permanently positioned for operation.

Once at the installation site, the ATM is enabled to be separated from the pallet. In an exemplary method, the installation blocks 21 are separated from the pallet. Various fasteners can also be unfastened so as to render one or more of the pallet components to be separable. If other or additional means had been utilized to secure the ATM to the pallet, they will be unfastened at this point.

In the exemplary embodiment, an installation block 21 is placed on the floor surface under each leveling leg 31. The leveling legs 31 are then extended downward by rotation of the threaded portion until they engage the installation blocks 21. Once engaged, the leveling legs 31 are further extended downward until the pallet is no longer supporting the ATM, but rather the ATM is supported by the floor surface through the support blocks.

At this point remaining component fasteners can be removed from the pallet. The pallet is disassembled by removing at least one component. The support brackets are disengaged from the legs by moving the legs horizontally out of the open end slots. The plurality of pallet components and the plurality of component fasteners are removed from beneath the ATM. In this manner, the plurality of pallet components and component fasteners allow for disassembly of the pallet at the installation site.

Figure 8:
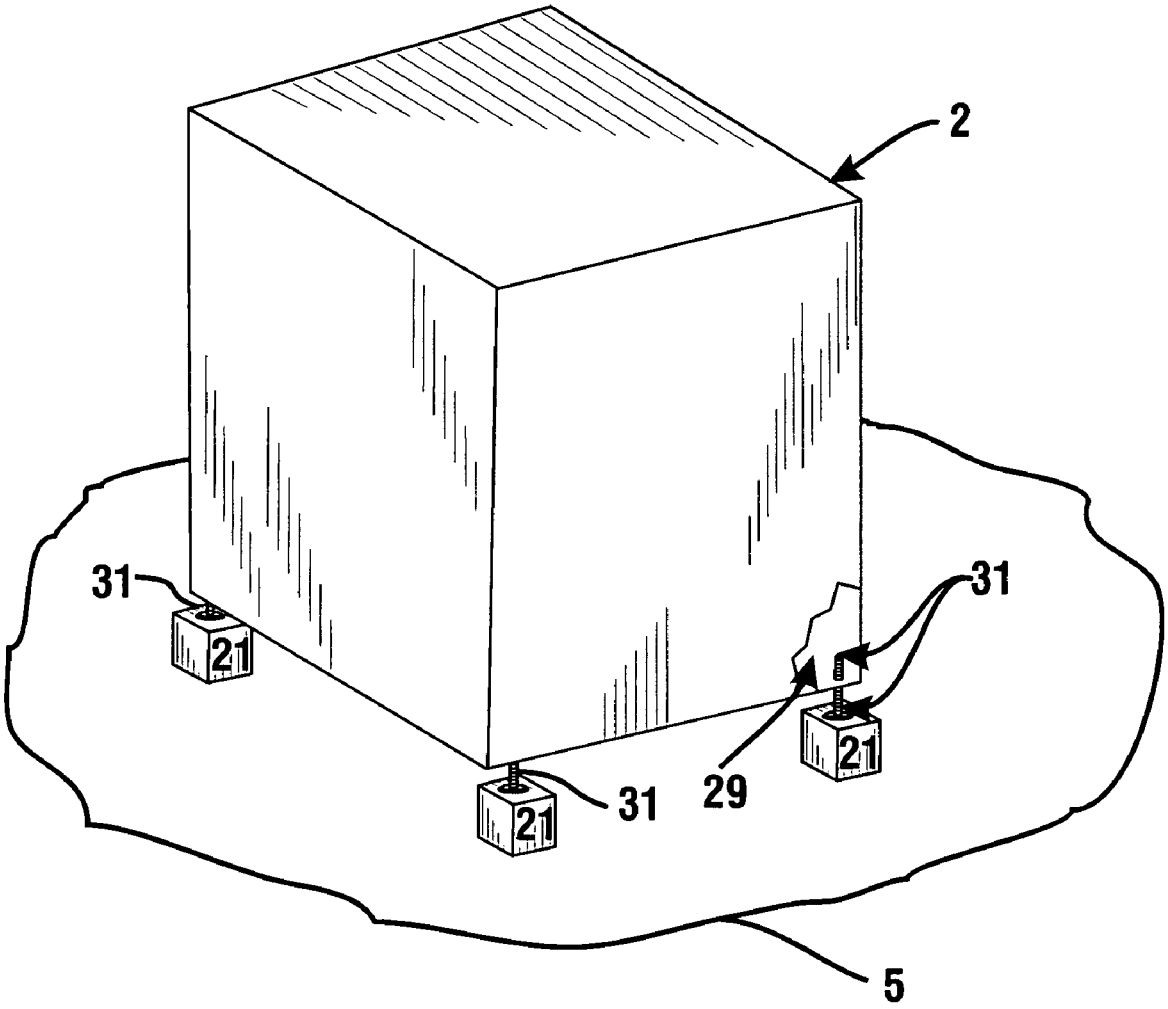
FIG. 8 is a view of the ATM supported on leveling legs engaging installation blocks with the pallet removed.

FIG. 8 illustrates the exemplary ATM supported on its leveling legs on the installation blocks with the other pallet components and fasteners removed. The ATM 2 is supported by its plurality of leveling legs 31, which are operatively connected to the base 29 of the ATM, and are engaged with the plurality of installation blocks 21, which in turn are supported on the floor surface 5.

From this condition, a lifting device (such as a pallet jack, pallet truck, fork lift truck, etc.) may be used to lift the ATM off the installation blocks. If desired, additional lifting height of the conventional lifting device may achieved by placing wood (such as conventional 2"×6" lumber) on the top of the lifting surface of the lifting device. At this point, the installation blocks may be removed, and the ATM is lowered until the leveling legs 31 contact the floor surface 5. The ATM may then be lowered and/or leveled utilizing the leveling legs 31. Alternatively, once the ATM is supported on the lifting device it may be moved in supporting connection therewith to the exact final installation location. Once in the final installation location, the legs may be vertically adjusted to level the ATM. The leveling of the ATM helps to assume the proper operation of the sensitive mechanisms within the ATM.

Of course, in other embodiments movable supports of different types may be used other than the exemplary leveling legs. In some embodiments, the leveling legs or other vertical adjustment and support devices may have adequate length to facilitate the installation process without the use of the installation blocks. In that case, the vertical adjustment and support devices would be extended directly into engagement with the floor surface initially, and the steps of using the installation blocks and the lifting of the ATM with a lifting device other than the support devices may be eliminated. In those cases, the plurality of movable supports may be extendable through the pallet to contact the floor surface to provide vertical support for the ATM while the pallet is being disassembled and removed from underneath the ATM.

In alternative embodiments the ATM may not have integral vertical adjustment and support devices. Temporary internal or external vertical adjustment and support lifting devices could be used, either with or without the function of the installation blocks.

The system and methods of the exemplary embodiment are adapted for use with ATMs of a particular configuration. Other configurations could be utilized to accommodate different ATMs and different types of vertical adjustment and support devices. Some such devices could be integral to the ATM, while, in other cases, the ATM might have only support points, holes or other features, and no integral vertical adjustment and support devices, in which case the vertical adjustment and support devices could be portable and applied externally to the support points of the ATM. Modifications to the pallet could be made to provide vertical travel under ATM support points in other ways. Some ATM and vertical adjustment and support device combinations may, for example, provide vertical travel under the ATM support points or vertical adjustment and support devices without the need for a cantilever shipping plate, and in those instances the cantilever shipping plate or other slotted pallet portion would not be used.

Thus the exemplary ATM shipping and installation apparatus and methods achieve one or more of the above stated objectives, eliminate difficulties encountered in the use of prior devices and systems, solve problems and attain the desirable results described herein.

In the foregoing description certain terms have been used for brevity, clarity and understanding, however no unnecessary limitations are to be implied therefrom because such terms are used for descriptive purposes and are intended to be broadly construed. Moreover, the descriptions and illustrations herein are by way of examples and the invention is not limited to the exact details shown and described.

In the following claims any feature described as a means for performing a function shall be construed as encompassing any means known to those skilled in the art to be capable of performing the recited function, and shall not be limited to the features and structures shown herein or mere equivalents thereof. The description of the exemplary embodiment included in the Abstract included herewith shall not be deemed to limit the invention to features described therein.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims.

We claim:

1. Apparatus comprising:

a cash dispensing automated teller machine (ATM), wherein the ATM includes a base, wherein the ATM includes a plurality of leveling legs, wherein the legs are operably connected to the base, wherein the legs are vertically extendable and retractable relative to the base, wherein the legs are adapted to support the ATM, wherein each leg includes a bottom portion, wherein each bottom portion is configured for floor surface engagement;

a pallet, wherein the pallet includes a plurality of separable pallet components enabling assembly and disassembly of the pallet, wherein the pallet components include a plurality of support components, a plurality of removable fasteners, and a plurality of elongated metal brackets, wherein each bracket includes a first end and a second end separated in an elongated direction of the bracket, wherein the first end includes a plurality of bracket holes, wherein each hole is configured to have a said fastener extend therethrough to enable the bracket to be removably fastened to a said support component, wherein when the bracket is fastened to the support component, the second end extends horizontally outward from the support component, wherein the second end includes an open end slot extending in the elongated direction, wherein the slot is sized to allow at least a part of a said leveling leg to move therethrough, wherein the slot is sized to prevent a said leg bottom portion moving therethrough, wherein the pallet when fully assembled is operative to support the ATM, wherein when the ATM is supported by the pallet fully assembled and the leveling legs are fully retracted relative to a floor surface underlying the pallet, then both the ATM is in secured connection with the pallet via the leg bottom portions being in secured engagement with the brackets, and a free space extends vertically from each leg bottom portion to the floor surface, enabling a support block to be positioned therein.

2. An apparatus according to claim 1, wherein the plurality of pallet components further comprises cushion material.

3. An apparatus according to claim 1, wherein the plurality of pallet components further comprises polyethylene foam material.

4. An apparatus according to claim 1, and further comprising support blocks, wherein the pallet includes a predetermined support block storage area, wherein each support block is releasably attachable to a pallet component in the predetermined support block storage area, wherein each support block is adapted to be removed from the predetermined support block storage area and positioned in a free space, and wherein each support block is configured to engage a respective leg to enable support of the ATM through the support blocks.

5. The apparatus according to claim 4 wherein the support blocks comprise four support blocks, wherein the four support blocks are configured to support the ATM, wherein the ATM includes four leveling legs, wherein each of the four leveling legs is positioned intermediate the ATM and a respective one of the four support blocks during support of the ATM by the four support blocks, whereby the four support blocks support the ATM through the four leveling legs.

6. The apparatus according to claim 4 wherein each of the support blocks is positionable on the floor surface vertically underlying a respective leveling leg while the pallet supports the ATM.

7. An apparatus according to claim 1 and further comprising a plurality of disassembly support blocks, wherein the support blocks are configured to support the ATM while the pallet while underlying the ATM is being disassembled.

8. An apparatus according to claim 1 wherein the separable pallet includes four metal brackets, wherein the ATM includes four leveling legs, and wherein each open end slot of each of the four metal brackets is adapted to have a respective one of the four leveling legs extend therethrough.

9. The apparatus according to claim 1 and further comprising support blocks, wherein the support blocks are configured for connection to at least one predetermined pallet component via the removable fasteners.

10. The apparatus according to claim 9 wherein one predetermined pallet component is sized to simultaneously support the support blocks, wherein the support blocks are configured for fastening connection to the one predetermined pallet component.

11. The apparatus according to claim 10 wherein the support blocks comprise four substantially identically shaped support blocks, wherein the one predetermined pallet component is sized to simultaneously support the four support blocks.

12. The apparatus according to claim 9 wherein the pallet with connected support blocks is adapted to support the ATM during transport thereof, wherein the connected support blocks do not provide support to the ATM, wherein the support blocks are separable form connection with the pallet while the remainder of the pallet supports the ATM, wherein separated support blocks are positionable to provide support to the ATM while the remainder of the pallet does not support the ATM.

13. The apparatus according to claim 1 wherein the pallet is in an assembled condition and is in supporting connection with the ATM.

14. The apparatus according to claim 13 wherein each leveling leg extends downward from the base.

15. The apparatus according to claim 14 wherein each leveling leg is in threaded engagement with the base, wherein rotation of a leveling leg moves the leg vertically in a respective slot.

16. The apparatus according to claim 15 wherein the ATM includes a chest portion housing a currency dispenser, and wherein each leveling leg extends in the chest portion.

17. The apparatus according to claim 16 wherein each leveling leg includes a tool engaging head located in the chest portion, and wherein rotation of a tool engaging head causes rotation of a leveling leg.

18. The apparatus according to claim 17 and further comprising at least one support block, wherein each support block is adapted to be positioned vertically between a slot and the floor surface to enable the leveling legs to support the ATM on the floor surface through the at least one support block.

19. The apparatus according to claim 18 wherein the at least one support block comprises four support blocks, and wherein the plurality of leveling legs comprise four leveling legs.

20. The apparatus according to claim 18 wherein in the assembled condition the plurality of removable fasteners hold the separable pallet components together.

* * * * *